United States Patent [19]

Pearson et al.

[11] 4,059,308

[45] Nov. 22, 1977

[54] PRESSURE SWING RECOVERY SYSTEM FOR OIL SHALE DEPOSITS

[75] Inventors: Durk J. Pearson, Palos Verdes Estates; Jack R. Bohn, Rancho Palos Verdes, both of Calif.

[73] Assignee: TRW Inc., Redondo Beach, Calif.

[21] Appl. No.: 741,637

[22] Filed: Nov. 15, 1976

[51] Int. Cl.[2] ..... E21C 41/10

[52] U.S. Cl. ..... 299/5; 166/259; 166/303

[58] Field of Search ..... 299/2, 4, 5; 166/259, 166/303

[56] References Cited

U.S. PATENT DOCUMENTS

| | | | |
|---|---|---|---|
| 3,273,640 | 9/1966 | Huntington | 166/303 X |
| 3,502,372 | 3/1970 | Prats | 299/5 |
| 3,753,594 | 8/1973 | Beard | 299/4 |
| 3,759,328 | 9/1973 | Ueber et al. | 299/4 |
| 3,759,574 | 9/1973 | Beard | 299/4 |
| 3,779,601 | 12/1973 | Beard | 299/4 |
| 3,957,306 | 5/1976 | Closmann | 299/4 |

*Primary Examiner*—Ernest R. Purser
*Attorney, Agent, or Firm*—John J. Connors; Benjamin DeWitt; Donald R. Nyhagen

[57] ABSTRACT

A process for the in-situ recovery of hydrocarbon, carbon monoxide, and hydrogen values and associated minerals from subsurface oil shale deposits is provided by forming a gas-tight retort chamber and injecting it with various process gases which are pressure cycled over a predetermined period of time. This pressure cycling increases the extraction efficiency by improving the recovery of material contained in blink cracks in the underground formation, and by provising an independent means of controlling the thermal gradients induced in the deposit.

18 Claims, 4 Drawing Figures

PRESSURE SWING RECOVERY SYSTEM FOR OIL SHALE DEPOSITS

BACKGROUND OF THE INVENTION

In the past, oil shale deposits were mined and brought to the surface for further processing of the various components and constituents. This process was expensive, time-consuming, and dangerous. If the oil shale deposits were mined by open pit, their removal was time-consuming and expensive. Additional ecological problems render both these methods of extraction undesirable today.

A somewhat more dangerous approach involves underground tunneling into the shale oil deposits in a predetermined pattern for the purpose of blasting and rubblizing the oil shale deposit. After the deposit is rubblized, a flame front is instituted which causes an in-situ retorting of the hydrocarbon values in the shale. This process has met with varying success primarily because of difficulty of obtaining uniform rubble in the shale deposit with the attending problems of maintaining a reasonably uniform flame front and plastic flow of the rock material. If the rubble is not reasonably uniform, a substantially uniform flame front is not maintained and the retort flames are quenched by the retorting products or by-pass burning occurs. The plastic flow problems are particularly severe in the deposits richer in kerogen.

Various forms of pressure swings have been used in the past to improve recovery from oil fields. In one process, a down-holed gas/oxygen gun propagates shock waves through an oil field to crack the underground formation, thereby releasing additional pockets of oil. In another process, steam is cycled (huff and puff) so as to recover viscous oil from sand and gravel. Neither of these processes are suitable for the present invention. Shock waves play no part in the present process, and it is often desired to avoid further cracking rather than to cause it. With respect to the cycling steam process, it is applied only until the heated subsurface area of two adjacent wells come into contact and then it is replaced by continuous steam pressure drive. Moreover, the formations wherein "huff and puff" has been applied are essentially a mixture of heavy oil, sand, and gravel. They have neither the prominant horizontal layered structure nor the blind cracks of the oil shale deposits.

SUMMARY OF THE INVENTION

The present invention relates to pressure cycling of process gases in an in-place process for extracting water soluble minerals from an oil shale bed, generating and recovering oil from the artificially leached chamber produced by the mineral extraction, and the subsequent leaching of minerals which were water insoluble before retorting. This process can be used in conjunction with the process set forth in copending application Ser. No. 741,817, entitled *Recovery System for Oil Shale Deposits* by Hill et al. This process employs cyclic pressure swings of the process gases used in each of the recovery steps. Generally, these pressure swings may vary on the order of one cycle per minute to one cycle per day and have magnitudes of ± 35 percent of the ambient pressure in the chamber. In the absence of pressure fluctuations, process gases become stagnant in the blind fractures or cracks, i.e., those fractures or cracks which are open only at one end. When the pressure is cycled, the process gas is forced into and drawn out of the blind fractures, providing fresh processing gas and improved heat transfer with each cycle. Thus, the removal of the hydrocarbon, carbon monoxide, and hydrogen values or minerals is greatly enhanced. This effect is most clearly visualized by considering an empty blind crack. When filled with steam, the steam condenses to stagnant water, saturated with soluble minerals. Under constant pressure conditions, leaching would now cease. If the pressure is reduced, some of the water in the crack will boil, thereby expelling the saturated water, and making the crack accessible to fresh steam on the next pressure upswing.

These effects-improved material and heat transfer can also be obtained by pressure swings even when there is no phase change; since $PV \approx n\,RT$, the pressure swings will move process gas, products, and heat in blind cracks far more effectively than under stagnant constant pressure conditions.

DESCRIPTION OF THE PREFERRED EMBODIMENTS

Figure 1:
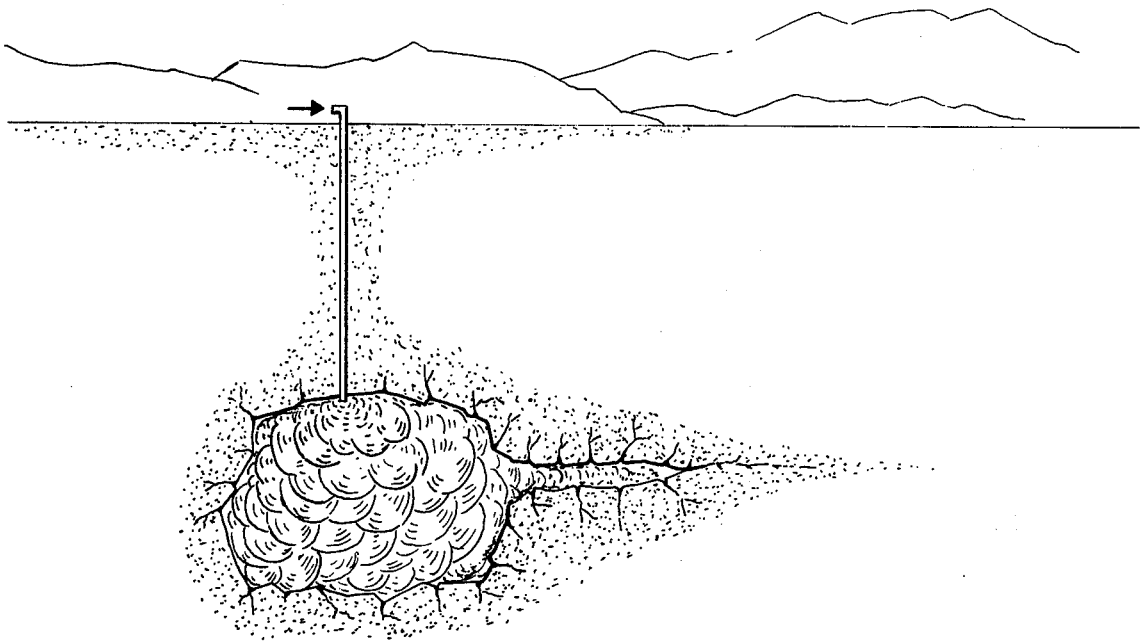
FIG. 1 shows the injection of the process gas into the retort chamber having a blind fracture or crack extending into the subsurface structure off the retort chamber.
Figure 2:
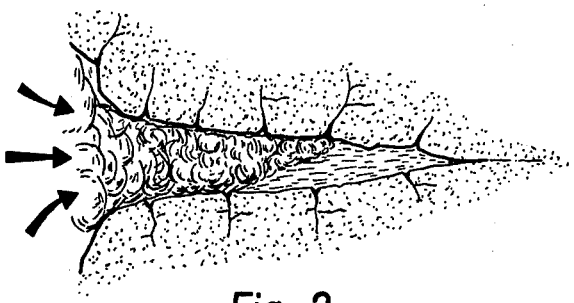
FIG. 2 is an enlargement of the blind fracture or crack showing the process gas being driven under pressure into the cavity.
Figure 3:
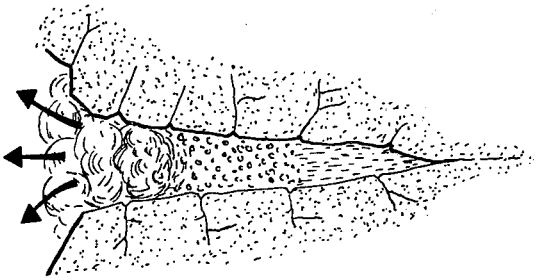
FIG. 3 is an enlargement of the blind fracture or crack showing mineral or hydrocarbon values being drawn out of the cavity after the pressure has been reduced.
Figure 4:
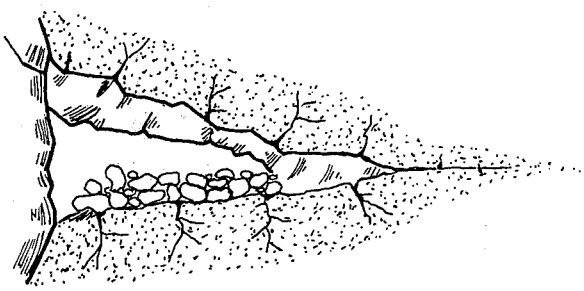
FIG. 4 is an enlargement of the blind fracture or cavity after it has been enlarged by repeated pressure cycling of the process gas.

The present invention is directed to the recovery of minerals, such as nahcolite, dawsonite, nordstrandite, shortite, trona, halite, hydrocarbon, and other fuel (such as $H_2$ and CO) values from subsurface formations by employing pressure cycling of the process fluids. Although the principals set forth in this process may be applicable to any oil shale deposit, the Piceance Creek Basin in northwestern Colorado is particularly suitable for application of this process. This area contains recoverable oil shale, nahcolite, and dawsonite spread over an area of about 300 square miles and approximately 900 feet in thickness. By employing an integrated in-place process, the nahcolite is first extracted followed by shale oil recovery, then by alumina recovery and secondary oil recovery, and finally by tertiary recovery using in-situ combustion. In order to obtain maximal recovery of the mineral and hydrocarbon values, the process must be conducted in a sequence of specific steps. In the first step, an oversized hole is drilled into the gas-tight overburden which is then encased and grouted to preserve the integrity of the overburden. The drill patterns may be in the form of individual wells or multiple wells. Where individual wells are used, a coaxial pipe is placed down the well hole and fluids are injected into the hole through an outer pipe while products are extracted through a center pipe. In a multiple well pattern, a central injector well is placed in a particular location and producer wells are located in the vicinity in any of a number of patterns.

In the deep deposits of the Piceance Creek Basin, solution mining of nahcolite is required initially to provide in-place access to the balance of the resource. Nahcolite is soluble in water and is decomposed by heat into sodium carbonate, carbon dioxide and water. Although the nahcolite occurs as nodules, veins, or disseminated crystals, these tend to be interconnected. To accomplish the nahcolite removal from the selected subsurface horizon, hot water or preferably steam is injected into the formation at the top of the completed borehole. Because considerable amounts of the nahcolite exist in blind fractures, i.e., fractures or cracks which are open only on one end, pressure pulsing may be employed to force condensible steam or hot water into the blind cracks and permitted to be expelled from the fracture or crack when the pressure is released. In this manner, saturated and stagnant solute is not continualy filling the crack. When the pressure is increased, new solute is forced into the crack or fracture, and when the pressure is reduced, a solution of nahcolite is expelled from the crack or fracture by pressure drop induced boiling or by gas expansion. The frequency of the cycle will depend upon the underground structure, the size of the retort cavity, the nature of the process fluids, and the thermal gradients desired. Generally, the pressure cycles will range from approximately one cycle per minute to one cycle per day. The exact frequency of the cycle will, of necessity, be determined in the field, though in general, a cavity will be cycled faster when small rather than when large. Likewise, the amount of the pressure being applied will depend upon the number of factors, e.g., the depth of the chamber, the temperature of the chamber, etc. Generally, pressure swings of +35% to −35% of the ambient pressure in the chamber would be sufficient to force the solute in and out of the blind cracks or fractures. After creating porosity in the formation by leaching the water-soluble nahcolite from the shale zone, chambers are pumped dry and in-situ retorting of the oil shale is conducted by the circulation of a hot fluid, such as heated low molecular weight hydrocarbon gas, steam, heated retort off-gas comprising $H_2$, CO, $CO_2$, $N_2$, and mixtures thereof, from the injection well through the permeable shale bed and out the producing well. Again, during the retorting process, the process fluid is pulsed as previously described.

The in-situ retorting process should be carried out in a temperature range of between 660° to 930° F, and preferably between 800° and 850° F. These temperature ranges will permit rapid completion of oil evolution from the raw shale and the decomposition of dawsonite to chi-alumina which occurs about 660° F. In addition, co-occurring with the dawsonite is nordstrandite which forms unleachable gamma-alumina at temperatures above 930° F. The retorting of oil shale at temperatures in the range of 800° to 850° F leads to a quality shale oil product with a typical pour point about 25° F, and API gravity of about 28° with a nitrogen content of less than 0.8 weight percent according to Hill and Dougen in *The Characteristics of a Low-Temperature In-Situ Shale Oil,* Quarterly of the Colorado School of Mines, Volume 62, No. 3, July 1967.

Oil vapor from the decomposition of kerogen is cooled by the formation ahead of the retorting front and can be condensed and drained into a pocket from which it can be pumped along with some water from the dawsonite decomposition. The off-gas produced by the kerogen in the retorting process includes four components comprising the hot fluid used for retorting, the gas from the kerogen decomposition, oil vapors, and the carbon dioxide and water vapor from the dawsonite decomposition. If the gas from the kerogen decomposition is used as the heat carrier for retorting, the resulting off-gas will have a medium heating value after the removal of the water and $CO_2$. After the retorting step has been completed, alumina which was formed from dawsonite and nordstrandite can be extracted. This light base extractable alumina, which was created when the oil shale was retorted at water temperatures, was formed by dawsonite when it was heated to 350° C according to the reaction as reported by Smith and Young in *Dawsonite: It's Geochemistry, Thermal Behavior, and Extraction from Green River Oil Shale,* paper presented at the Eighth Oil Shale Symposium, Colorado School of Mines, Golden, Colorado, Apr. 17–18, 1975. This alumina, which includes values from nordstrandite, can be extracted from the retorted oil shale by solution of 1N sodium carbonate and a surfactant for further recovery of unmobilized oil.

The requirements which must be met by the surfactant involve both chemical stability and proper functioning in a brine system containing very high concentrations of $NaHCO_3$ and $Na_2CO_3$, as well as small amounts of calcium and magnesium salts. In addition, the surfactant or surfactants must not interfere with the above ground alumina precipitation which occurs when $CO_2$ is added to the leach solution. Furthermore, the surfactant(s) should reduce the oil-brine interfacial tension, the oil-rock interfacial tension, and the brine-rock interfacial tension so that oil droplets are efficiently mobilized, and so that the leach brine efficiently contacts the alumina minerals. Finally, the properties of the surfactant(s) must be such as to permit the oil to be separated from the brine at the surface in an economical manner. Since the cavity is a sealed system, relatively expensive surfactants can be used economically compared to those used in oil field tertiary recovery practice.

In general, two classes of surfactants are of greatest interest; essentially all of the nonionic surfactants, and many of the anionic surfactants. Examples of a few of the nonionic surfactants are:

polyoxyethylene surfactants
ethoxylated alkylphenols
ethoxylated aliphatic alcohols
carboxylic esters
carboxylic amides
polyoxyalkylene oxide block copolymers
alkanol amines
alkanol amides Examples of a few of the anionic surfactants are:
alkyl sulfates
N-acyl-N-alkyltaurates
naphthalene sulfonates
alkyl benzene sulfonates
alkane sulfonates
alkanolamide sulfates
phosphate esters
sulfated alkylphenols Again, the leach liquor which is used to extract the alumina should be pressure pulsed as described previously.

Even with good yields from the primary and secondary recovery processes, rsidual fuel value will remain in the retort bed in the form of unmobilized oil and carbonaceous residue. Although this residue has little direct commercial value, it may yield sufficient fuel value to supply heat for the production of steam for the leach phase, the heating of retorting gas for hot gas retorting in another chamber, and the process heat required for gas treatment, etc. In addition, considerable amounts of liquid and vapor hydrocarbons will be mobilized and recovered in a tertiary stage. In view of this, a tertiary recovery step is effected which comprises removing water of the previous step from the retort chamber and instituting a flame front to combust the residue. Since much of the kerogen has already been removed, plastic flow problems are greatly reduced.

After combustion of the residue has begun, water vapor, as well as air or oxygen, is injected down the injector well hole. The water vapor reacts with the residue to hydrogenate the remaining unsaturated hydrocarbon values so that polymerization does not occur. By preventing polymerization of the hydrocarbon values during pyrolysis, the residue is fluid and readily flows as liquid or vapor in advance of the flame front. In addition, the presence of steam aids in mobilizing the fossil fuel values by means of the water gas reaction:

$$H_2O + C \rightarrow H_2 + CO$$

As practiced in the previous two recovery steps, pressure cycling is beneficial in the tertiary recovery step. In the tertiary recovery step, certain precautions must be taken by the pressure swings. The chief concern during the pressure swing would be the prevention of such abrupt changes as to extinguish or suppress the flame front, or to cause excessive mixing of combustible product gases with oxidizing process gas.

When all practical hydrocarbon and mineral values have been removed from the retort chamber, the chamber may be back-filled with water, solutions, or slurries to prevent subsidence of the soil and collapse of the underground structures. Aqueous solutions suitable for this purpose may comprise some of the excess minerals which were removed in the previous recovery processes. Thus, if more sodium bicarbonate is being removed than can be disposed of economically, the solutions or slurries of these materials may be pumped back into the ground for storage or later removal. Subsidence of the soil must be controlled to prevent process interruption and to minimize environmental damage. The vertical component of the stress field is governed by unit weight of the rock and the vertical depth to the opening. The reaction to this stress and size of the opening which can be tolerated without collapse will be governed by the strength of the rock immediately above the opening.

To minimize soil subsidence, extraction operations must leave pillars of undisturbed shale to support the overburden. This technique is commonly used in room and pillar mining. Thus, to reduce the possibility of earth subsidence which follows an initial roof collapse that causes stress and distruption of strata all the way to the earth's surface, backfilling with pressurized water or aqueous solutions or slurries should be considered.

After the chamber has been back-filled, the pipe may be plugged to seal the chamber. When the next level of mining has been determined, the pipe is perforated at that level and the process is repeated.

Each step of the process is integrated and interdependent upon obtaining the inputs of process fuels, chemicals, or working fluids which are supplied as outputs by some other previous stage. Thus, it would be impractical to pump large quantities of a basic leach solution into a borehole to recover alumina values unless the chamber had been leached and retorted previously. Likewise, recovery of hydrocarbon values from the oil shale would be difficult and expensive unless the chamber was first made porous and permeable by the nahcolite leach. Moreover, direct in-situ combustion of rich unretorted oil shale is not feasible due to plastic flow problems. The removal of a portion of the kerogen during retorting greatly reduces these problems. Therefore, in order to carry out the process in a logical and economic manner, the process steps must be followed in the sequence set forth previously.

Although there may be numerous modifications and alternatives apparent to those skilled in the art, it is intended that the minor deviations from the spirit of the invention be included within the scope of the appended claims, and that these claims recite the only limitations to be applied to the present invention.

We claim:

1. A process for the in-situ recovery of hydrocarbon values and associated minerals from subsurface oil shale deposits in which a gas-tight retort chamber can be produced comprising the steps of:
   a. drilling into said oil shale deposits;
   b. injecting steam into said shale deposits at varying pressures cycled over a predetermined time to dissolve and extract said associated minerals which are water soluble thereby forming a substantially gas-tight chamber;
   c. injecting hot, non-oxidizing gas into said shale deposit at varying pressures cycled over a predetermined time in said chamber whereby said associated minerals are decomposed and hydrocarbon fluids extracted;
   d. injecting a solvent-surfactant into said deposit at varying pressures cycled over a predetermined time and extracting said decomposed minerals and hydrocarbon fluids;
   e. removing said solvent-surfactant from said deposit;
   f. instituting a flame front and injecting air and water at varying pressures cycled over a predetermined time to combust hydrocarbon residue to produce liquid and gaseous hydrocarbons, CO, and $H_2$; and
   g. filling said chamber with a fluid selected from the group consisting of water, aqueous solutions, and aqueous slurries.

2. A process according to claim 1 wherein said shale deposit is beneath a layered salt deposit.

3. A process according to claim 1 wherein said associated minerals are selected from the group consisting of nahcolite, dawsonite, nordstrandite, shortite, trona, and halite.

4. A process according to claim 1 wherein said pressure swings are ±35 percent of the ambient pressure in the well.

5. A process according to claim 1 wherein said predetermined time ranges from one cycle per minute to one cycle per day.

6. A process according to claim 1 wherein said water soluble mineral is selected from the group consisting of halite, trona, and nahcolite.

7. A process according to claim 1 wherein said hot, non-oxidizing gas is selected from the group consisting of low molecular weight hydrocarbon gas, carbon dioxide, carbon monoxide, hydrogen, nitrogen, steam, and mixtures thereof.

8. A process according to claim 1 wherein said solvent-surfactant is an aqueous solution of a compound selected from the group consisting of sodium carbonate and sodium bicarbonate and a surfactant selected from the group consisting of alkanol amines, alkanol amides, polyoxyethylene oxide block copolymers, carboxylic amides, carboxylic esters, ethoxylated aliphatic alcohols, ethoxylated alkylphenol, polyoxyethylenes, alkyl sulfates, N-acy-N-alkyltaurates, naphthalene sulfonates, alkyl benzene sulfonates, alkane sulfonates, alkanol amide sulfates, sulfated alkylphenols, and phosphate esters.

9. A process according to claim 1 wherein said decomposed minerals become chi-alumina.

10. A process for the in-situ recovery of hydrocarbon values and associated minerals from subsurface oil shale deposits in which a gas-tight retort chamber can be produced comprising the steps of:

a. drilling at least one hole into the bottom of said shale deposit;
b. inserting piping to the bottom of said hole;
c. pumping steam down an injection pipe into said shale formation at varying pressures cycled over a predetermined time and extracting water soluble associated minerals from a producer pipe thereby forming a substantially gas-tight chamber;
d. injecting hot, non-oxidizing gas down said injection pipt into said shale deposit at varying pressures cycled over a predetermined time whereby said associated minerals are decomposed by heat and hydrocarbon fluids and are extracted from said producer pipe;
e. injecting a mixture comprising a surfactant and a portion of said water soluble mineral values previously obtained down said injection pipe at varying pressures cycled over a predetermined time and extracting said decomposed minerals and hydrocarbon fluids from said producing well;
f. clearing said chamber;
g. instituting a flame front and injecting air and water at varying pressures cycled over a predetermined time to combust hydrocarbon residue and extracting hydrocarbon values from said producer pipe for process heating;
h. filling said chamber with aqueous solution or slurry; and
i. raising the terminaton of said injector pipe and producer pipe a predetermined distance to begin the formation of the next gas-tight chamber in said shale deposit.

11. A process according to claim 10 wherein said shale deposit is beneath a layered salt deposit.

12. A process according to claim 10 wherein said associated minerals are selected from the group consisting of nahcolite, dawsonite, nordstrandite, shortite, trona, and halite.

13. A process according to claim 10 wherein said pressure swings are ±35 percent of the ambient pressure in the well.

14. A process according to claim 10 wherein said predetermined time ranges from one cycle per minute to one cycle per day.

15. A process according to claim 10 wherein said water soluble mineral is selected from the group consisting of halite, trona, and nahcolite.

16. A process according to claim 10 wherein said hot, nonoxidizing gas is selected from the group consisting of low molecular weight hydrocarbon gas, carbon dioxide, carbon monoxide, hydrogen, nitrogen, steam, and mixtures thereof.

17. A process according to claim 10 wherein said mixture is an aqueous solution of a compound selected from the group consisting of sodium carbonate and sodium bicarbonate and a surfactant selected from the group consisting of alkanol amines, alkanol amides, polyoxyethylene oxide block copolymers, carboxylic amides, carboxylic esters, ethoxylated aliphatic alcohols, ethoxylated alkylphenol, polyoxyethylenes, alkyl sulfates, N-acyl-N-alkyltaurates, naphthalene sulfonates, alkyl benzene sulfonates, alkane sulfonates, alkanol amide sulfates, sulfated alkylphenols, and phosphate esters.

18. A process according to claim 10 wherein said decomposed minerals become chi-alumina.

* * * * *